United States Patent [19]

Morgan

[11] 4,020,508

[45] May 3, 1977

[54] ALTERNATE TOILET BOWL FLUSH APPARATUS

[75] Inventor: Leo J. Morgan, Farmingdale, N.Y.

[73] Assignee: The Raymond Lee Organization, Inc., New York, N.Y. ; a part interest

[22] Filed: Oct. 14, 1975

[21] Appl. No.: 622,364

[52] U.S. Cl. ..... 4/67 A; 4/67 R

[51] Int. Cl.[2] ..... E03D 1/34; E03D 5/02; A61B 19/00

[58] Field of Search ..... 4/67 R, 67 A, 57 R, 4/57 P, 34, 37, 18

[56] References Cited

UNITED STATES PATENTS

| | | | |
|---|---|---|---|
| 2,709,263 | 5/1955 | Doty | 4/67 A |
| 2,940,084 | 6/1960 | Fabbi et al. | 4/67 A |
| 3,041,630 | 7/1962 | Williams | 4/67 A |
| 3,151,337 | 10/1964 | Deniz | 4/34 |
| 3,731,324 | 5/1973 | Moon | 4/18 |
| 3,766,571 | 10/1973 | Elder et al. | 4/67 A |
| 3,839,747 | 10/1974 | Clark | 4/67 A |
| 3,842,444 | 10/1974 | Greuenhagen | 4/67 A |
| 3,916,455 | 11/1975 | Longdin | 4/67 A |
| 3,939,507 | 2/1976 | Clark | 4/67 A |

*Primary Examiner*—Henry K. Artis
*Attorney, Agent, or Firm*—Howard I. Podell

[57] ABSTRACT

A toilet bowl flush apparatus allowing either a total or partial flush from the tank of the apparatus. The tank of the device is fitted with a discharge outlet located on the bottom of the tank. The discharge outlet is closed by a floatable ball-cock of larger diameter than the outlet, with the ball-cock tied by a pull chain to a first valve lever. A vertical sleeve surrounds the discharge outlet and ball-cock and is tied by a pull chain to a second valve lever. The external valve handle is linked to the control handle shaft which actuates only the first valve lever when the control handle is rotated in a first direction and actuates both the second valve levers when the control handle is rotated in the second direction, opposed to the first direction. Actuation of the first valve lever serves to lift the ball-cock within the sleeve to permit the water in the tank to discharge only until the tank level reaches the level of the top of the sleeve, while actuation of the second valve lever serves to lift the sleeve and the ball-cock to permit the tank to fully discharge.

3 Claims, 2 Drawing Figures

ALTERNATE TOILET BOWL FLUSH APPARATUS

SUMMARY OF THE INVENTION

My invention relates to a toilet bowl and tank flush apparatus which may selectively discharge either the partial or full water content of the toilet tank.

The tank of the device is fitted with a discharge outlet located on the bottom of the tank. The discharge outlet is closed by a floatable ball-cock of larger diameter than the outlet, with the ball-cock tied by a pull chain to a first valve lever. A vertical sleeve surrounds the discharge outlet and ball-cock and is tied by a pull chain to a second valve lever. The external valve handle is linked to the control handle shaft which actuates only the first valve lever when the control handle is rotated in a first direction and actuates both the second valve levers when the control handle is rotated in the second direction, opposed to the first direction.

Actuation of the first valve lever serves to lift the ball-cock within the sleeve to permit the water in the tank to discharge only until the tank level reaches the level of the top of the sleeve, while actuation of the second valve lever serves to lift the sleeve and the ball-cock to permit the tank to fully discharge.

BRIEF DESCRIPTION OF THE DRAWINGS

The object and features of the invention may be understood with reference to the following detailed description of an illustrative embodiment of the invention, taken together with the accompanying drawings in which.

DESCRIPTION OF THE PREFERRED EMBODIMENT

Figure 1:
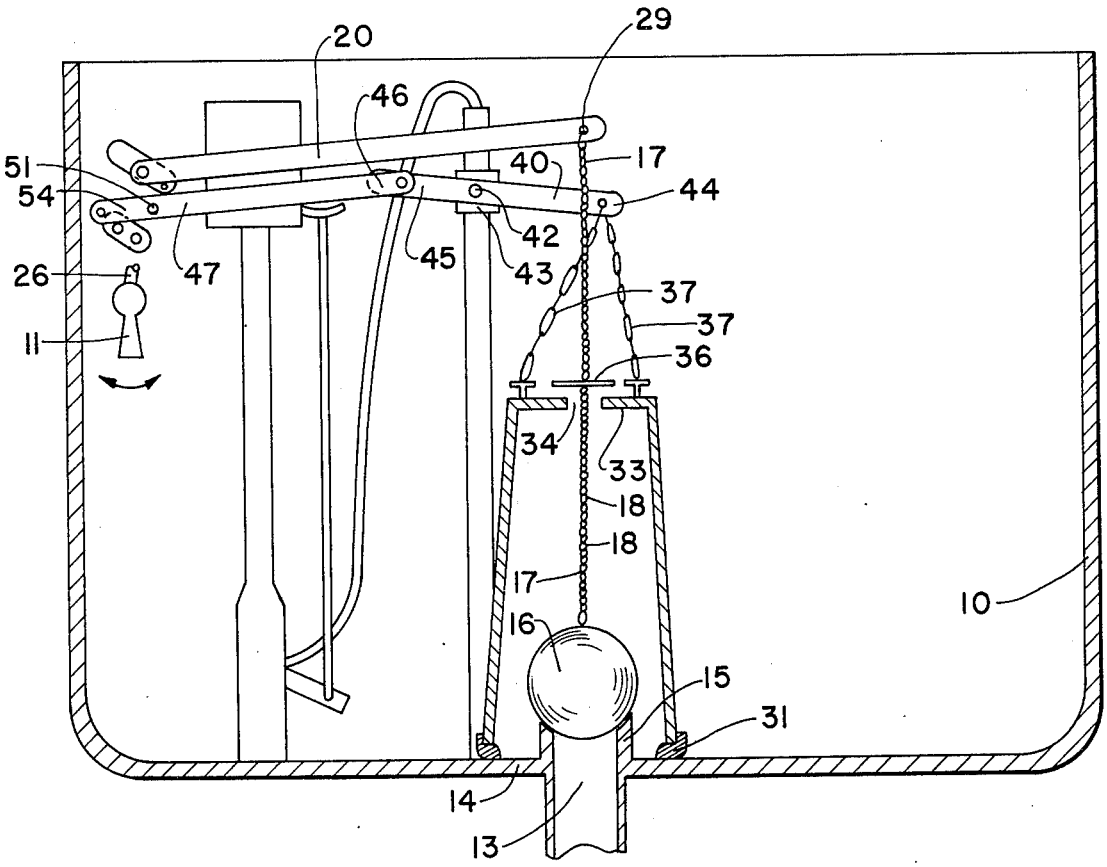
FIG. 1 illustrates a cross sectional side view of the toilet tank of the invention.
Figure 2:
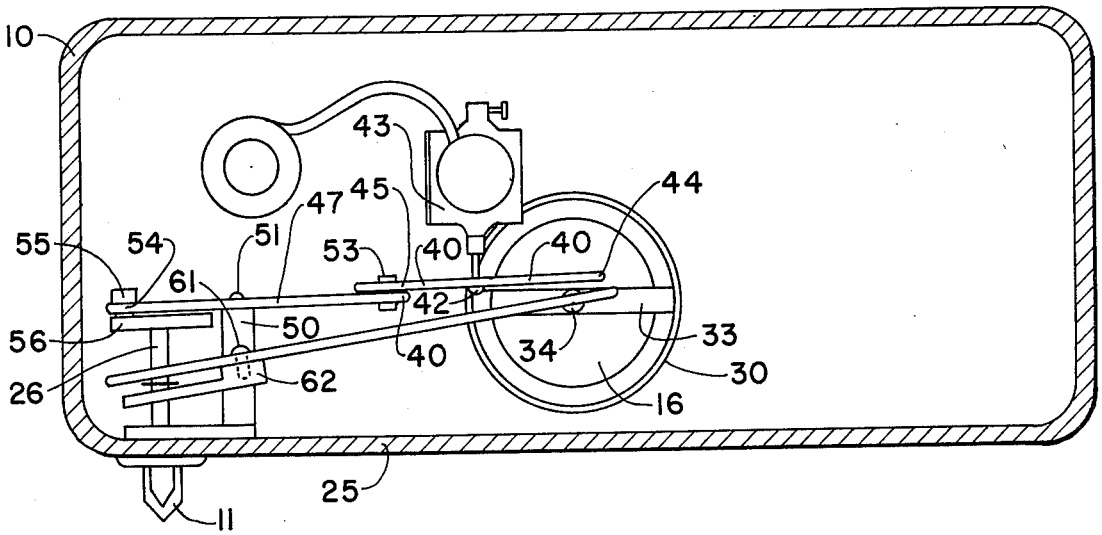
FIG. 2 illustrates a top view of the toilet tank of the invention.

Turning now descriptively to the drawings, in which similar reference characters denote similar elements throughout the several views, FIGS. 1–2 show a toilet bowl flush tank 10 which is selectively controlled to either furnish a total or partial flush of the toilet tank 10, depending on the direction of manual rotation of flush handle 11.

The discharge outlet 13 of tank 10 is fixed to the bottom wall 14 of the tank 10 and fitted inside the tank with a circular rim 15 to seal about a rubber ball-cock 16 when ball-cock 16 is seated on rim 15. Ball-cock 16 is linked by a flexible bead chain 17 fastened to operating lever 20 through hole 29 of lever 40.

A circular sleeve 30 is fitted along its bottom rim with a flexible sealing gasket 31 and loosely fits about ball-cock 16 so as to serve as a seal about discharge outlet 13, when sleeve 30 is in the seated position. Sleeve 30 is fitted with a fixed strap arm 33 across the top rim of sleeve 30, with strap arm 33 formed with a central hole 34 of a size to permit the beads 18 of chain 17 to freely pass through hole 34. A clip 36 is fitted to bead chain 17 above strap arm 33 so that upward motion of sleeve 30 and strap arm 33 lifts clip 36 and attached chain 17 so as to also lift ball-cock 16. A flexible chain 37 is fastened to strap arm 33 and a first end 44 of operating lever 40.

Operating lever 40 is pivotably mounted to the vertical fill pipe 41 by pivot screw 42 fixed to collar 43 mounted on pipe 41 with end 45 of lever 40 pivotably pinned by screw 53 to a first end 46 of control lever 47. Control lever 47 is pivotably pinned in its mid-section by pin 51 to a bracket arm 50 fixed to the interior of front tank wall 25 adjacent to operating shaft 26 fixed to handle 11. The second end 54 of lever 47 extends beyond shaft 26 to rest above a cam projection 55 of cam 56, with cam 56 fixed to shaft 26. Upward motion of cam projection 55 caused by clockwise rotation of handle 11 and shaft 26 serves to rotate lever 47 clockwise to rotate lever 40 counterclockwise to lift sleever chain 37 and sleeve 30, while counterclockwise rotation of handle 11 and cam 56 does not cause lever 47 or the attached sleeve 30 to move. The directions stated are based on viewing the internal mechanism from the direction of the front wall 25 of the bowl.

Operating lever 20 is pivotably mounted about shaft 26 with a cam peg 61 fastened to cam 62 resting under lever 20 between shaft 26 and the attachment hole 29 of chain 17. Cam 62 is fixed to shaft 26, so that the rotation of handle 11 and shaft 26 in the counterclockwise direction causes cam peg 61 to lift lever 20 and rotate it in the counterclockwise direction to lift attached bead chain and ball-cock 16.

Since lifting of sleeve 30 by chain 37 causes a strap arm 33 to lift clip 36 and bead chain 17, the lifting of sleeve 30 causes both sleeve 30 and ball-cock 16 to become unseated about discharge orifice 13 causing a full flush of the tank contents.

However, lifting of ball-cock 16, only, by operation of lever 20 does not unseat sleeve 30 and the water in the tank 10 falls to the lever of the top of sleeve 30 or to the lever of an opening (not shown) in the side of sleeve 30.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A toilet bowl tank designed to alternately discharge the full or a partial amount of water in the tank, said tank fitted with a discharge outlet in the bottom wall of the tank and fitted with a ball-cock valve that rests, in a first position, on the rim of the discharge outlet of the tank, said tank fitted with a sleeve that rests, in a first position, on the bottom wall of the tank in vertical orientation about the ball-cock valve and discharge outlet, with first lifting means linked to a handle mounted on an external wall of the tank so as to lift the ball-cock valve to a second position, said second position of the ball-cock valve being above the discharge outlet so that the ball-cock valve is clear of engagement with the rim of the discharge outlet, and with a second lifting means linked to said handle so as to lift the sleeve to a second position, said second position of the sleeve being clear of engagement with the tank bottom wall surounding the discharge unit, said first and second lifting means being independently linked by means to the handle such that manual operation of the handle alternately actuates only one of the said lifting means in response to a given direction of movement of said handle, with said first lifting means fastened to the ball-cock valve by a flexible tension member that passes freely through a hole in a member fixed to the top of the sleeve, and with a projection fastened to the tension member above the sleeve, said projection of a larger size than the said hole so that lifting of the sleeve by the second lifting means serves to also lift the said projection and the attached ball-cock valve.

2. The combination as recited in claim 1 in which the bottom rim of the sleeve is fitted with a flexible sealing material.

3. The combination as recited in claim 1, in which the handle is rotatably mounted to the tank wall and linked to the first and second lifting means by means selectively and alternatively responsive to the direction of manual rotation of the handle from the rest position of the handle, with the rotation of the handle in a given direction from said rest position serving to actuate only the first lifting means and with the rotation of the handle in the direction opposed to said given direction from said rest position serving to actuate only the second lifting means.

* * * * *